US009089857B2

(12) United States Patent
Sesser et al.

(10) Patent No.: US 9,089,857 B2
(45) Date of Patent: Jul. 28, 2015

(54) SIDE LOAD SPRINKLER NOZZLE SYSTEM

(71) Applicant: Nelson Irrigation Corporation, Walla Walla, WA (US)

(72) Inventors: George L. Sesser, Walla Walla, WA (US); Meade M. Neal, Walla Walla, WA (US); Barton R. Nelson, Walla Walla, WA (US)

(73) Assignee: NELSON IRRIGATION CORPORATION, Walla Walla, WA (US)

( * ) Notice: Subject to any disclaimer, the term of this patent is extended or adjusted under 35 U.S.C. 154(b) by 337 days.

(21) Appl. No.: 13/626,472

(22) Filed: Sep. 25, 2012

(65) Prior Publication Data

US 2013/0082119 A1 Apr. 4, 2013

Related U.S. Application Data

(60) Provisional application No. 61/540,594, filed on Sep. 29, 2011.

(51) Int. Cl.

| | |
|---|---|
| ***B05B 1/16*** | (2006.01) |
| ***B05B 3/02*** | (2006.01) |
| ***B05B 1/30*** | (2006.01) |
| *B05B 1/26* | (2006.01) |
| *B05B 3/04* | (2006.01) |

(52) U.S. Cl.

CPC ... *B05B 1/16* (2013.01); *B05B 1/30* (2013.01); *B05B 1/1627* (2013.01); *B05B 1/26* (2013.01); *B05B 1/3026* (2013.01); *B05B 3/0472* (2013.01)

(58) Field of Classification Search

CPC ..... B05B 1/16; B05B 1/1645; B05B 1/1663; B05B 1/262; B05B 3/02

USPC ..... 169/37, 41, 90; 239/214, 222.11, 461, 239/600, 391, 392, 393, 397

See application file for complete search history.

(56) References Cited

U.S. PATENT DOCUMENTS

| | | | | |
|---|---|---|---|---|
| 141,620 | A * | 8/1873 | Barton | 239/393 |
| 2,060,943 | A | 11/1936 | Lieb | |
| 2,281,229 | A | 4/1942 | Bullock | |
| 2,918,200 | A | 12/1959 | Libit et al. | |
| 4,801,089 | A | 1/1989 | Zeman | |
| 5,234,169 | A | 8/1993 | McKenzie | |
| 5,253,807 | A | 10/1993 | Newbegin | |
| 5,335,859 | A | 8/1994 | Thayer et al. | |
| 5,411,350 | A | 5/1995 | Breault | |
| 5,456,411 | A | 10/1995 | Scott et al. | |
| 5,487,507 | A | 1/1996 | McDonald et al. | |
| 5,560,548 | A | 10/1996 | Mueller et al. | |
| 5,699,962 | A | 12/1997 | Scott et al. | |

(Continued)

OTHER PUBLICATIONS

U.S. Appl. No. 13/556,324, filed Jul. 24, 2012 (pending).

(Continued)

*Primary Examiner* — Justin Jonaitis

(74) *Attorney, Agent, or Firm* — Nixon & Vanderhye P.C.

(57) ABSTRACT

A sprinkler head includes a sprinkler body having an inlet bore at one end, and a nozzle carrier supporting at least one nozzle is attached to the sprinkler body for pivoting movement between a nozzle-offset position and a nozzle-installed position. The nozzle carrier is provided with a shut-off surface portion for shutting off flow through the sprinkler body when the nozzle carrier is moved to the nozzle-offset position.

22 Claims, 19 Drawing Sheets

(56) References Cited

U.S. PATENT DOCUMENTS

| | | | | |
|---|---|---|---|---|
| 5,727,739 | A | 3/1998 | Hamilton | |
| 5,762,269 | A * | 6/1998 | Sweet | 239/71 |
| 5,884,847 | A | 3/1999 | Christopher | |
| 6,234,411 | B1 | 5/2001 | Walker et al. | |
| 6,244,527 | B1 | 6/2001 | Ferrazza et al. | |
| 6,398,128 | B1 | 6/2002 | Hamilton et al. | |
| 6,405,902 | B2 | 6/2002 | Everett | |
| 6,447,027 | B1 | 9/2002 | Lilley et al. | |
| 6,669,120 | B2 | 12/2003 | Vernia | |
| 6,676,038 | B2 | 1/2004 | Gressett, Jr. et al. | |
| 6,749,134 | B2 | 6/2004 | Arenson et al. | |
| 6,772,964 | B2 | 8/2004 | Funseth et al. | |
| 6,871,795 | B2 | 3/2005 | Anuskiewicz | |
| 6,880,768 | B2 | 4/2005 | Lau | |
| 7,431,346 | B2 | 10/2008 | Frost et al. | |
| 7,472,840 | B2 | 1/2009 | Gregory | |
| 7,644,877 | B2 | 1/2010 | Drechsel | |
| 7,980,490 | B2 | 7/2011 | Waddelow et al. | |
| 2004/0217196 | A1 | 11/2004 | Yurek, Jr. et al. | |
| 2007/0131792 | A1 | 6/2007 | Gardner et al. | |
| 2009/0200796 | A1 | 8/2009 | Lai | |
| 2009/0321543 | A1 * | 12/2009 | Lawyer et al. | 239/600 |
| 2010/0025983 | A1 | 2/2010 | Rosch et al. | |
| 2010/0102149 | A1 * | 4/2010 | Lawyer et al. | 239/722 |
| 2010/0108783 | A1 | 5/2010 | Joseph et al. | |
| 2013/0026254 | A1 * | 1/2013 | Sesser et al. | 239/395 |

OTHER PUBLICATIONS

U.S. Appl. No. 13/490,534, filed Jun. 7, 2012 (pending).
U.S. Appl. No. 13/776,051, filed Feb. 25, 2013 (pending).

* cited by examiner

SIDE LOAD SPRINKLER NOZZLE SYSTEM

This application claims priority from U.S. Provisional Application Ser. No. 61/540,594 filed Sep. 29, 2011, the entire contents of which are incorporated herein by reference.

BACKGROUND

This invention relates generally to sprinkler heads primarily used in (but not limited to) agricultural applications, and specifically, to a side-load nozzle arrangement for such sprinkler heads.

For most rotary-type sprinkler heads where a stream of water from a fixed nozzle impinges on a rotatable water deflector plate, the nozzle is removable and interchangeable with nozzles of different size, i.e., nozzles with different orifice diameters. Typically, however, the water supply must be shut off and the sprinkler head at least partially disassembled in order to remove and replace the nozzle. It is also oftentimes desirable to simply shut off one or more sprinklers mounted, for example, on a truss span of a linear or center-pivot irrigator, in order to provide a desired sprinkling pattern as determined by factors such as soil condition, topography, type of crop being irrigated, and so on.

While there have been proposed solutions to the disassembly aspect of nozzle interchange using various, fairly complex multi-nozzle turret arrangements for selectively installing nozzles of different size, the lack of simple and reliable nozzle-change and shut-off features in a rotary sprinkler head remains problematic.

BRIEF SUMMARY OF THE INVENTION

In a first exemplary but nonlimiting embodiment, the invention described herein provides a sprinkler head comprising a sprinkler body having a flow passage including an inlet at one end thereof; and a nozzle carrier supporting at least one nozzle, the nozzle carrier supported on the sprinkler body downstream of the flow passage for pivoting movement about a substantially horizontal axis between a nozzle-installed position where the at least one nozzle is aligned with the flow passage and a nozzle-offset position where a shut-off surface portion of the nozzle carrier is aligned with the flow passage for shutting off flow through the sprinkler body.

In still another aspect, there is provided a sprinkler head comprising a sprinkler body having a bore extending therethrough and defining a flow passage; a nozzle carrier supporting at least one nozzle, the nozzle carrier supported on the sprinkler body for pivoting movement between a nozzle-offset position and a nozzle-installed position, the nozzle carrier also provided with a shut-off surface for shutting off flow through the flow passage when the nozzle carrier is moved to the nozzle-offset position; and wherein the nozzle carrier is releasably locked to the sprinkler body in the nozzle-installed position by spring arms provided with tabs engageable with the sprinkler body.

In still another aspect, there is provided a sprinkler head comprising a sprinkler body having an inlet bore at one end; a nozzle carrier supporting at least one nozzle, the nozzle carrier supported on the sprinkler body for pivoting movement about a substantially horizontal axis between a nozzle-offset position and a nozzle-installed position where the at least one nozzle is aligned with the inlet bore, the nozzle carrier also provided with a nozzle support platform provided with a shut-off surface on an upper side of the nozzle support platform for shutting off flow through the inlet bore when the nozzle carrier is moved to the nozzle-offset position; and a nozzle holder on an underside of the nozzle support platform for securing the at least one nozzle on the nozzle carrier.

In still another aspect, the invention provides a sprinkler head comprising a sprinkler body formed with flow passage, a nozzle carrier supporting at least one nozzle, the nozzle carrier supported on the sprinkler body for pivoting movement about a substantially horizontal axis; wherein the at least one nozzle is aligned with the flow passage when the nozzle carrier is moved to a nozzle-installed position, the nozzle carrier also provided with a shut-off surface for shutting off flow through the flow passage when the nozzle carrier is moved to the nozzle-offset position; a nozzle holder on an underside of the nozzle carrier for securing the at least one nozzle on the nozzle carrier, the nozzle holder comprising a support hub including a bore receiving a center hub of the at least one nozzle and at least two resilient support tabs radially spaced from the support hub, such that a nozzle bore extending through the nozzle center hub is aligned with the flow passage when the nozzle carrier is in the nozzle-installed position.

In still another aspect, the invention provides a nozzle clip comprising a first attachment member including side stems and a center section adapted to support a pair of adjacent nozzles; and a second locking member adapted to receive free ends of the stems.

The invention will now be described in greater detail in connection with the exemplary drawings identified below.

DETAILED DESCRIPTION OF THE INVENTION

Figure 1:
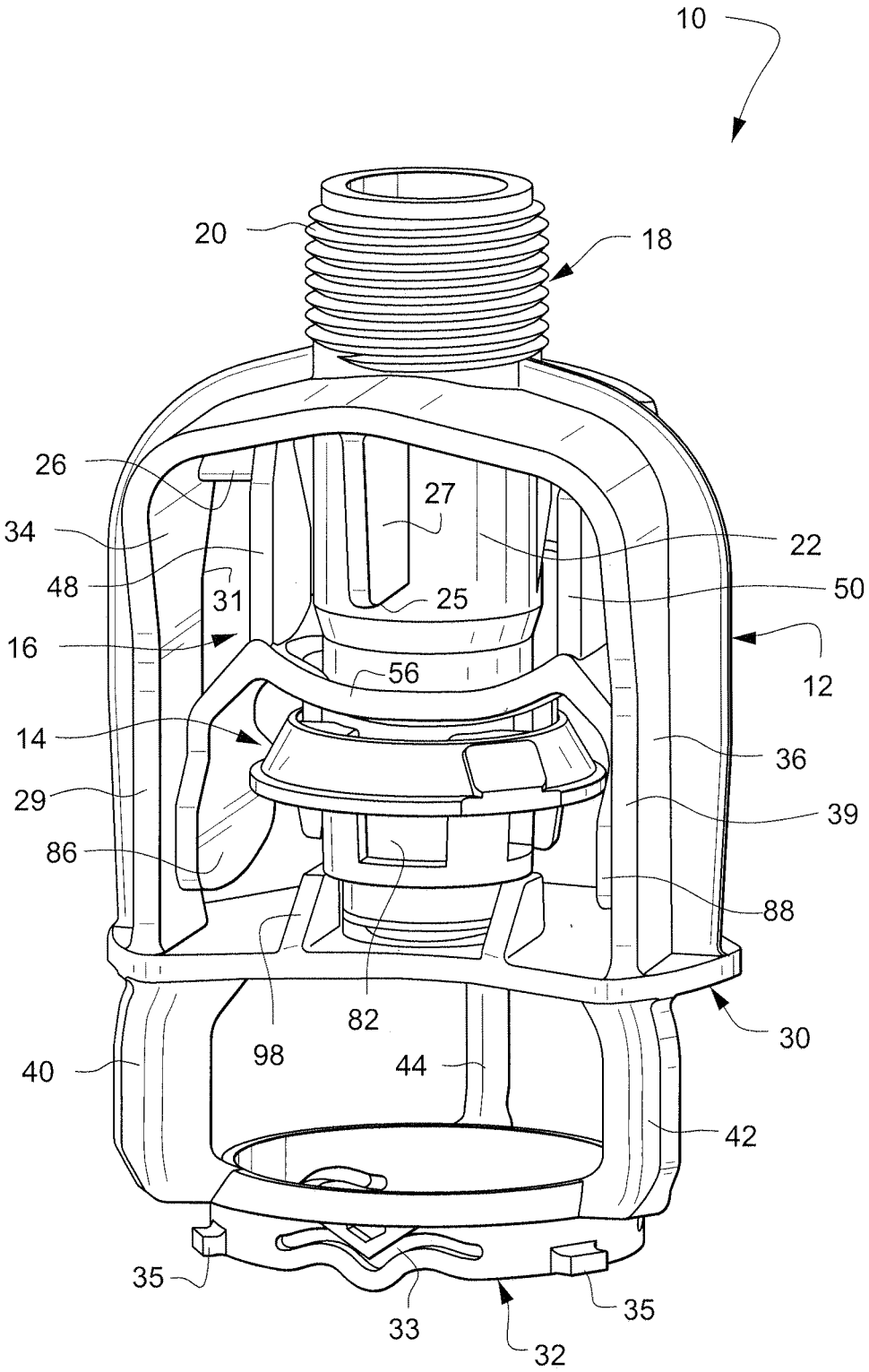
FIG. 1 is a front perspective view of a sprinkler head formed with a side-load nozzle arrangement and including a shut-off feature, with the nozzle carrier in a nozzle-installed position.

FIG. 1 illustrates an exemplary but nonlimiting sprinkler head 10 which includes a body 12 that supports a nozzle 14 via a nozzle carrier or shuttle 16 as described further below. The body 12 is best appreciated from FIG. 8 where the nozzle 14 and nozzle carrier 16 have been removed for ease of understanding. The body 12 has three significant features/functions: (1) the body is formed with an inlet adapter 18 that enables the sprinkler head to be connected to a drop tube, riser or other irrigation component (e.g., a pressure regulator) via the threaded inlet end 20. The adapter 18 also includes an extended substantially cylindrical portion 22 projecting axially into the body and providing a flow passage 24 (FIGS. 3, 5 and 7) to the nozzle; (2) the body supports the nozzle carrier 16 via pivot bosses 26, 28 (FIGS. 5 and 8) and provides an intermediate nozzle guide platform 30; and (3) the body may be provided with a coupling element or ring 32 by which an otherwise conventional, rotatable or stationary water distributor or deflector plate (not shown) may be connected to the sprinkler head. Additional details with respect to each feature are provided below. It will be understood that the water distributor or deflector plate is impinged upon by a stream emitted from the nozzle and redirects the stream in a different direction, e.g., substantially radially outwardly.

With reference also to FIGS. 1-7, the inlet adapter 18 and intermediate nozzle guide platform 30 are vertically-spaced and connected by means of plural struts 34, 36, 38 that are spaced about, and joined to, the adapter 18 adjacent the inlet end 20. This arrangement provides the space needed to accommodate the extended adapter portion 22 and the nozzle carrier 16 as also explained further below. Pivot bosses 26, 28 are formed in the upper ends of two of the three struts 34, 36 that are diametrically opposed and laterally aligned, thus defining a horizontal pivot axis for the nozzle carrier 16 as explained further below.

The nozzle guide platform 30 and coupling ring 32 (if employed) are also vertically-spaced and connected by plural struts 40, 42, 44 that may be (but not necessarily) aligned with the struts 34, 36, 38. A vertical center axis "A" (FIGS. 3 and 8) passes through the flow passage 24, the nozzle 14 (when in the operative or installed position), a center opening 46 (see, e.g., FIGS. 7, 8) in the guide platform 30 and through the center of the coupling ring 32, to thereby establish an axial flow path/direction for a stream supplied to the inlet adapter 18.

Figure 6:
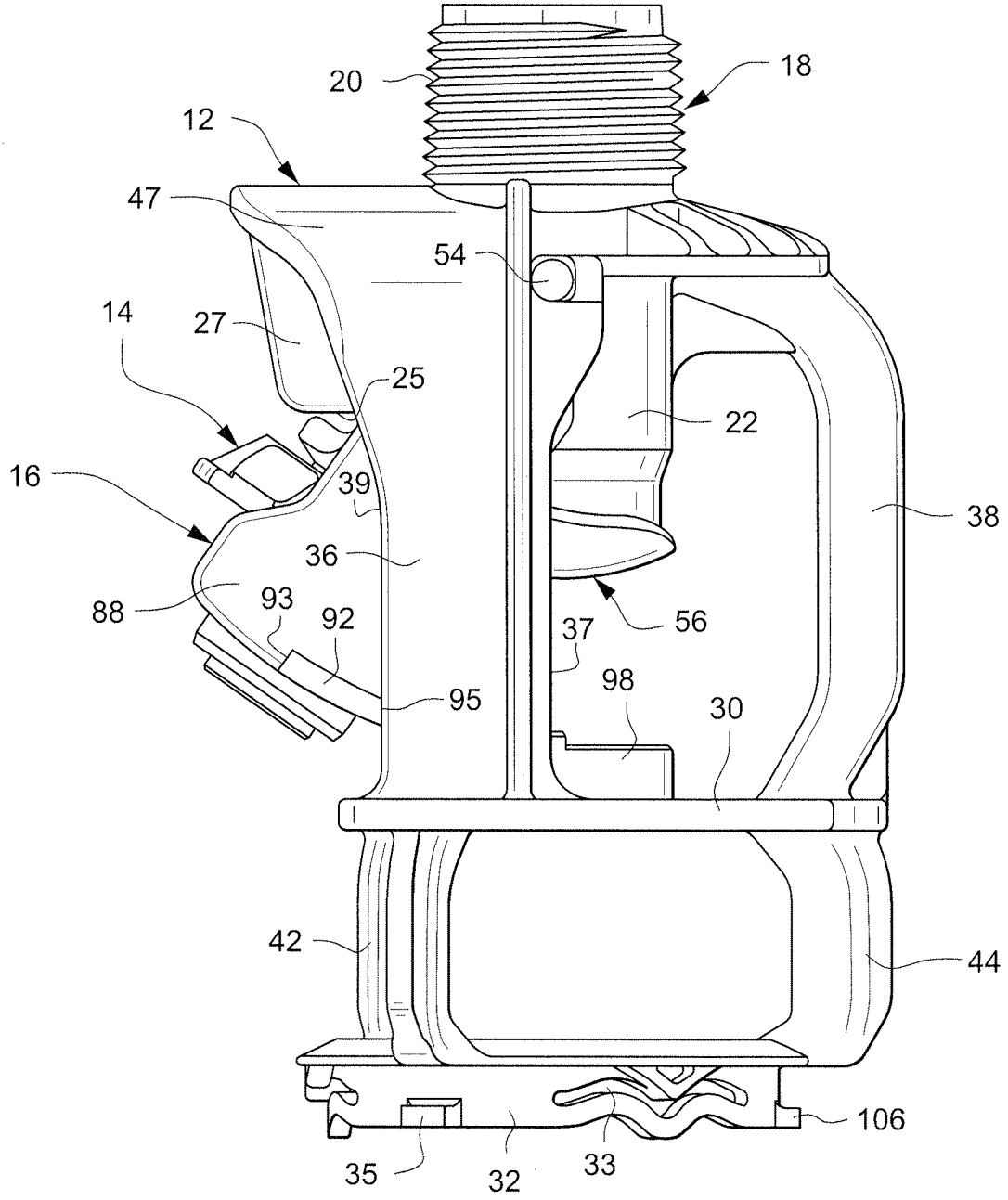
FIG. 6 is a right side view of the sprinkler head as shown in FIG. 2, but with the nozzle carrier or receiver rotated to a nozzle-offset position.

The diametrically-opposed struts 34, 36 are formed to include an extended and substantially horizontal shield portion 47 (best seen in FIGS. 2 and 6) that provides a degree of protection for an offset nozzle when the nozzle carrier is pivoted to the nozzle-offset or sprinkler shut-off position (see FIG. 6).

Figure 3:
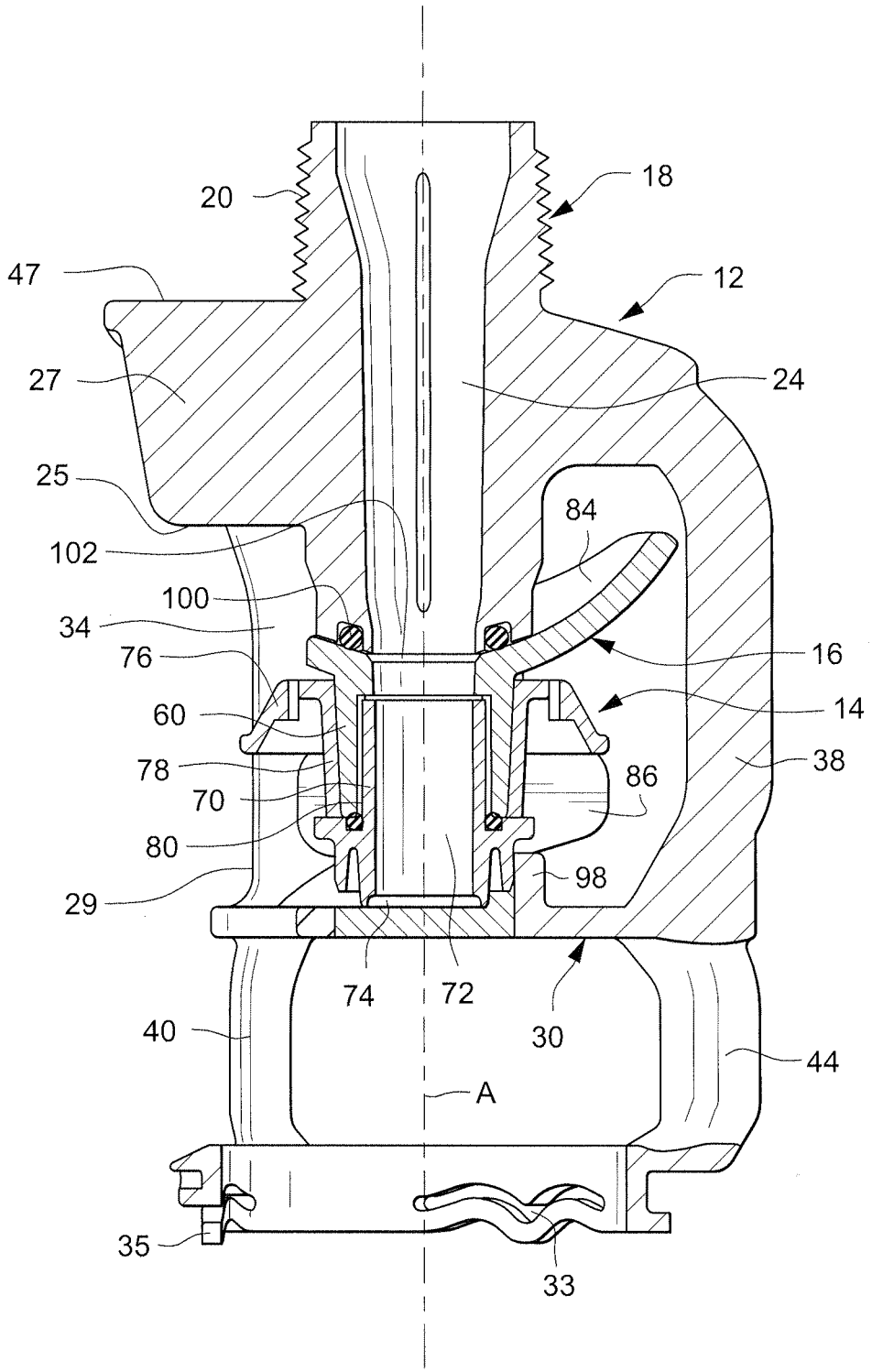
FIG. 3 is a vertical section through the center of the sprinkler head as shown in FIG. 2.
Figure 5:
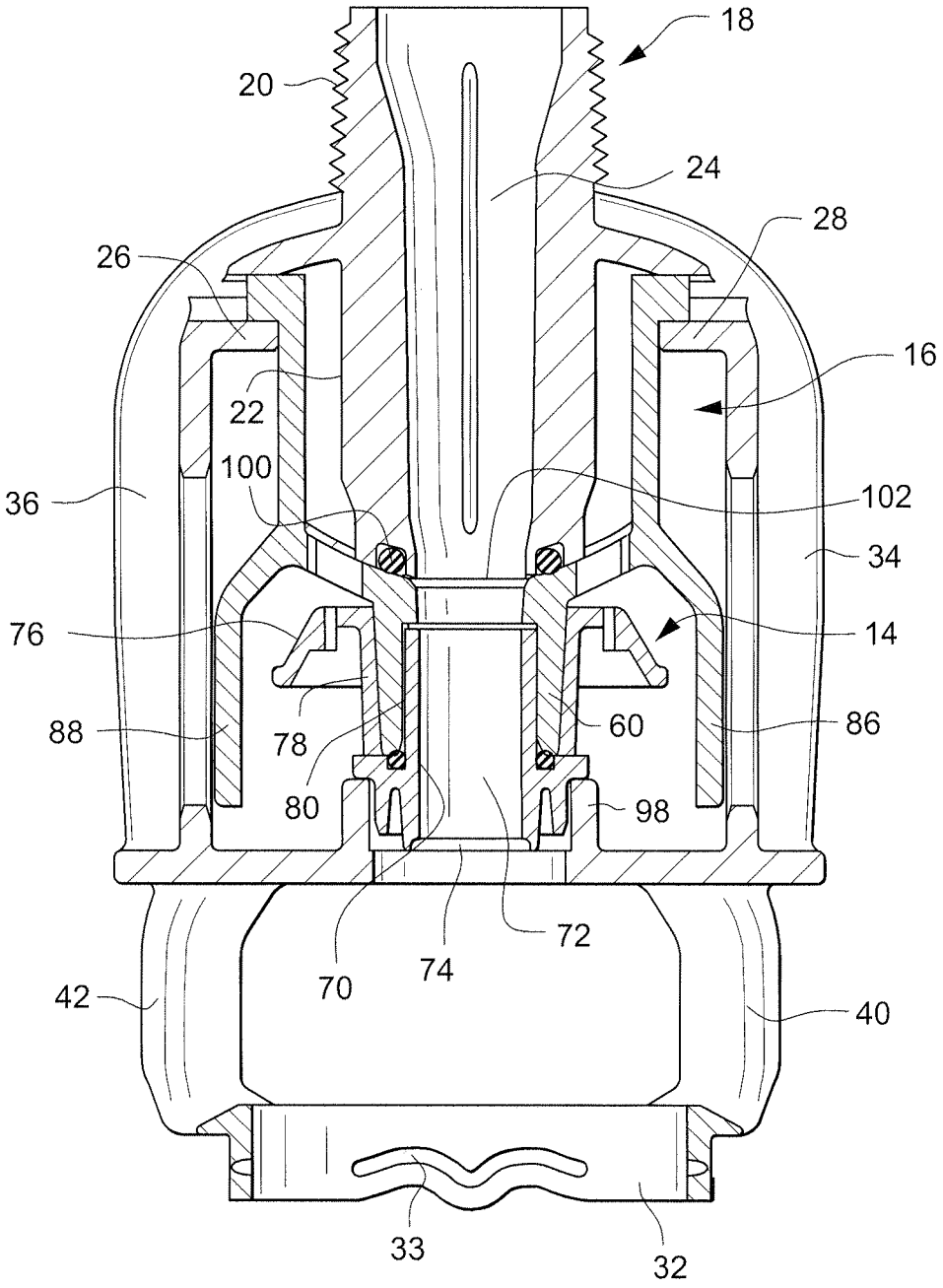
FIG. 5 is a vertical section through the center of the sprinkler head as shown in FIG. 4.
Figure 7:
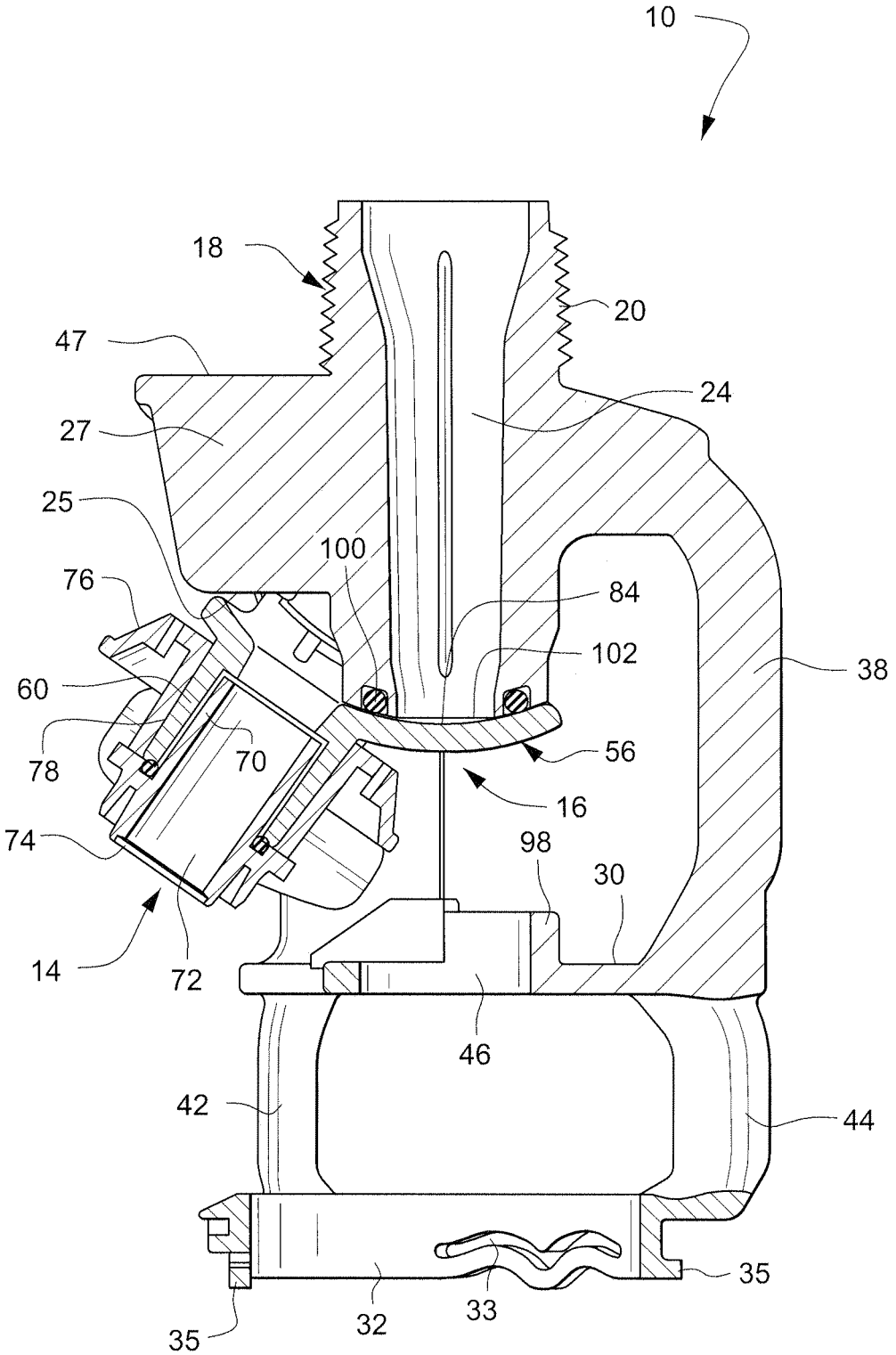
FIG. 7 is a vertical section through the center of the sprinkler head as shown in FIG. 6.
Figure 8:
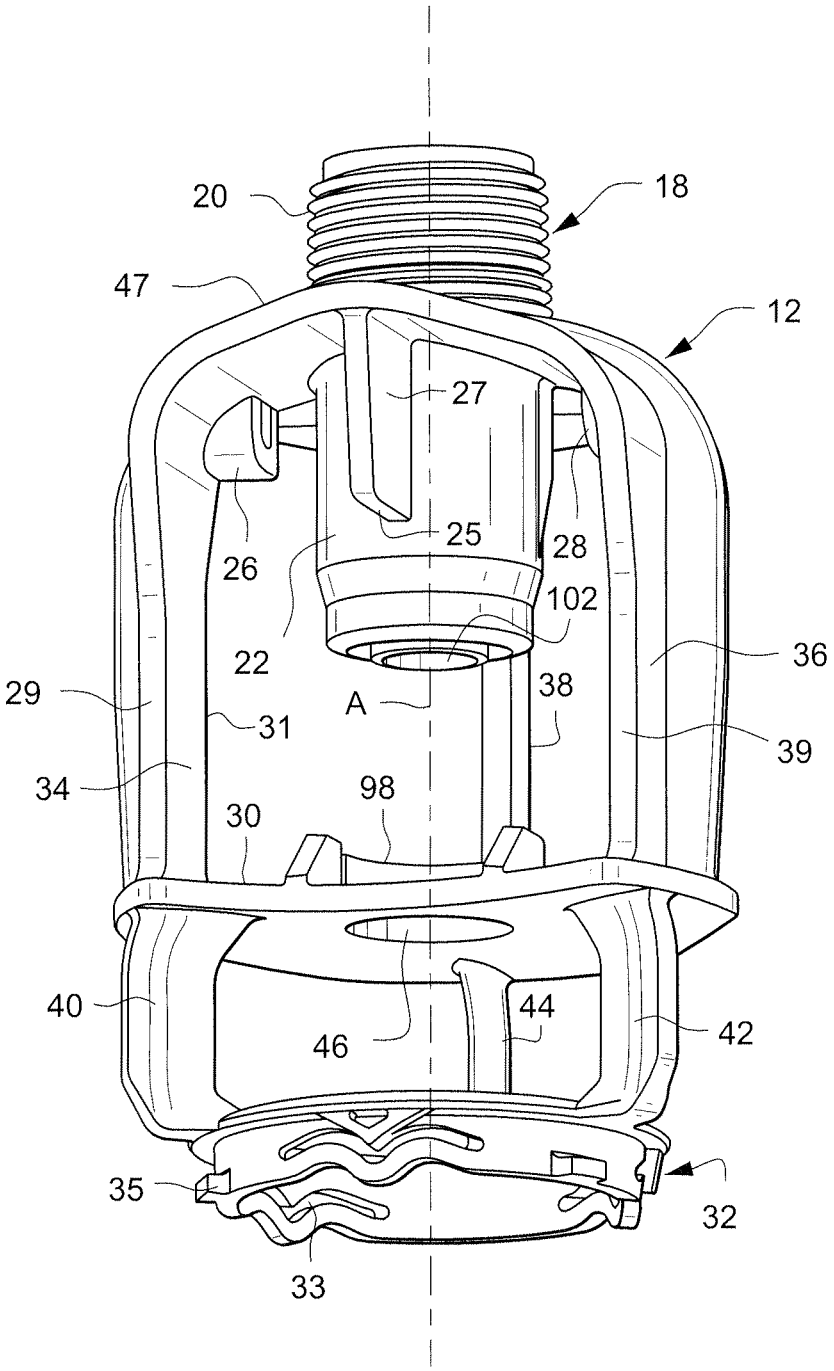
FIG. 8 is a front, right perspective view of the sprinkler head shown in FIG. 1, but with the nozzle carrier removed.
Figure 9:
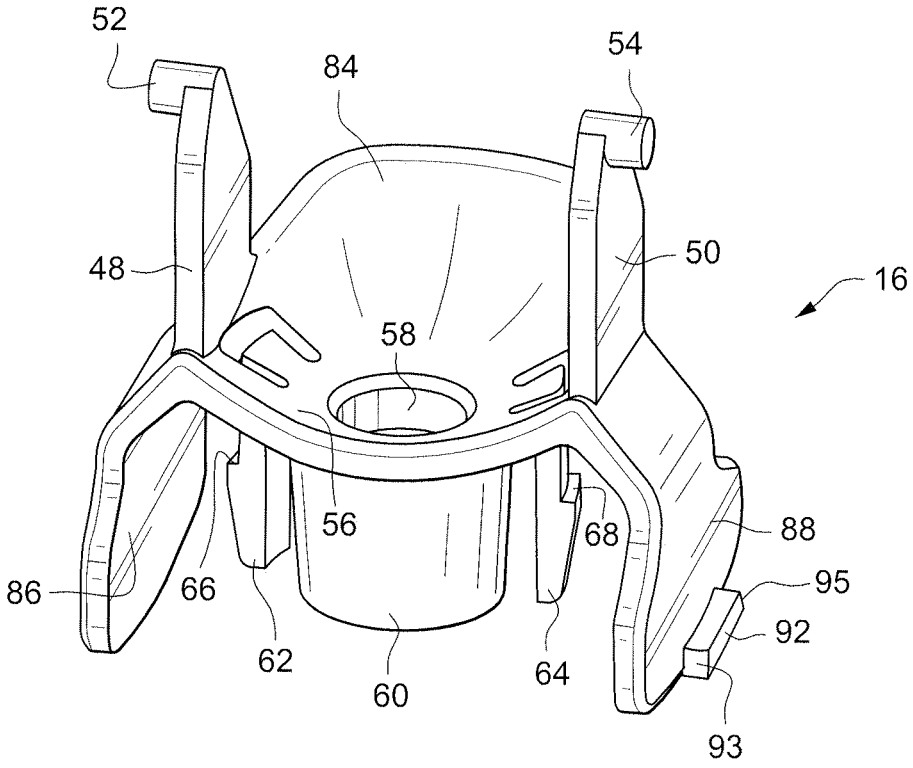
FIG. 9 is a front perspective view of the nozzle carrier removed from the sprinkler head.
Figure 10:
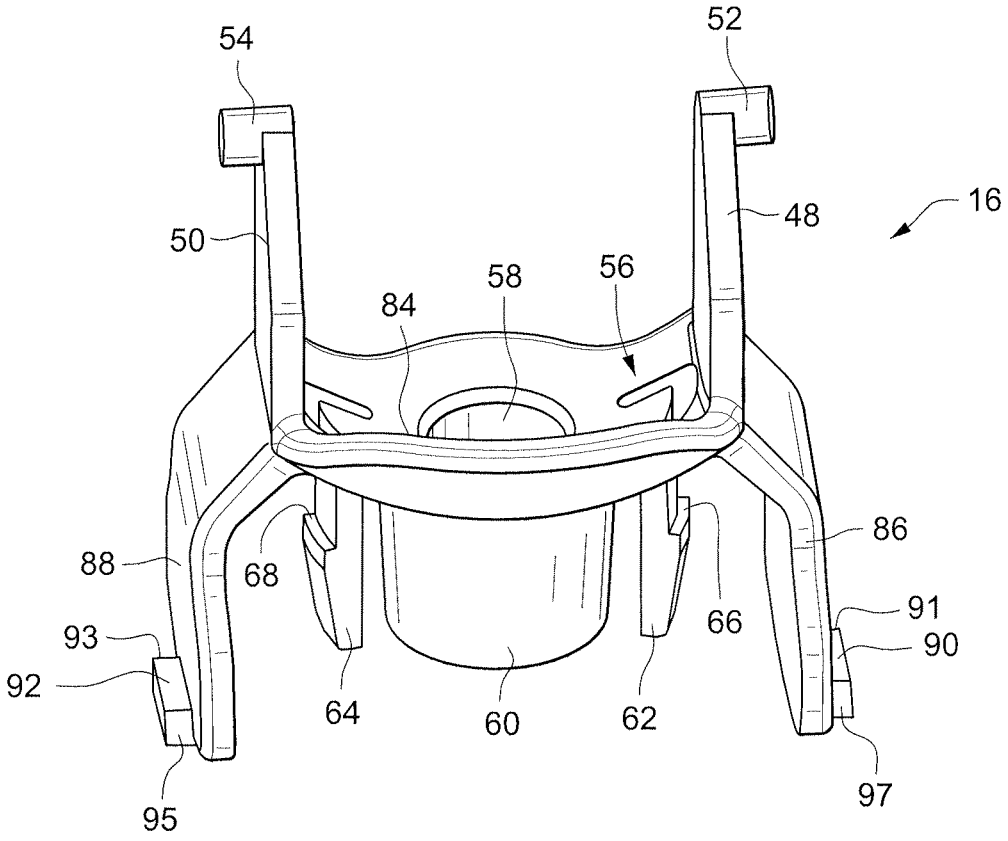
FIG. 10 is a rear perspective view of nozzle carrier as shown in FIG. 9.

With reference now to FIGS. 9 and 10, the nozzle carrier 16 is formed to include a pair of upstanding pivot ears 48, 50, each formed with a substantially perpendicular pivot pin 52, 54, respectively, receivable within the opposed pivot bosses 26, 28 to thereby establish a pivot capability for the nozzle carrier. The pivot ears 48, 50 extend from a nozzle support platform 56 having a generally upwardly-concave shape and formed with bore 58 that continues through a cylindrical support hub 60 projecting from its underside. The support hub 60 is flanked by a pair of resilient tabs 62, 64 formed integrally with the support platform 56, and radially spaced from the hub. The support hub 60 and resilient tabs 62, 64 together provide a nozzle holder. Note that the tabs 62, 64 are provided with integral (or attached) shoulders 66, 68, respectively that enables a nozzle to be resiliently and releasably locked in place on the nozzle carrier. More specifically, and as best seen in FIGS. 3, 5 and 7, the nozzle 14 is formed with a center hub 70 defining a nozzle bore 72 and a nozzle orifice 74. An outer peripheral ring 76 (which may be used for nozzle size identification purposes) is supported by means of webs or spokes 78 that establish an annular gap 80 between the spokes and the nozzle center hub 70.

Figure 4:
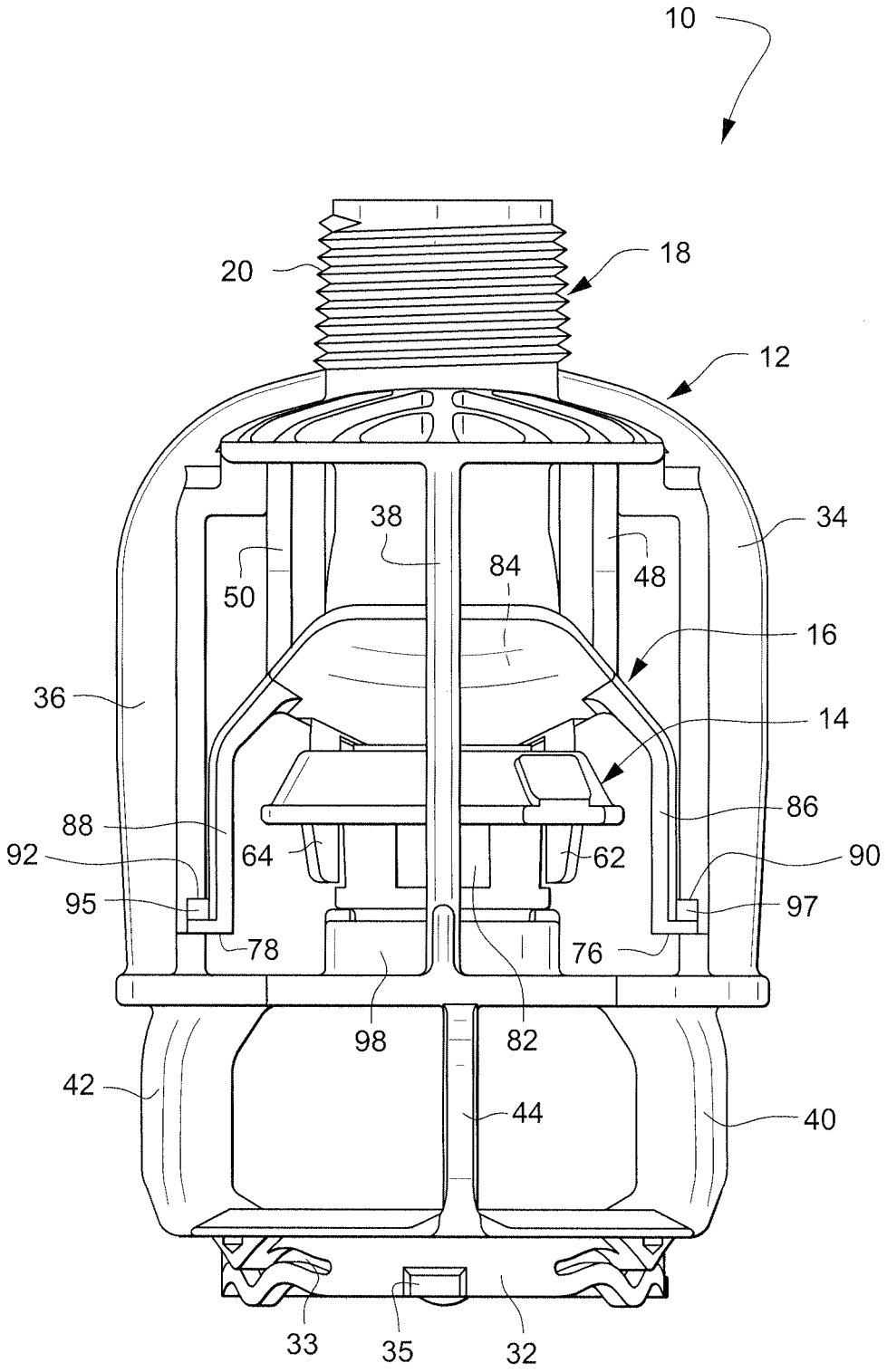
FIG. 4 is a rear view of the sprinkler head shown in FIGS. 1-3.

Circumferentially between the webs or spokes 78, there is a plurality of openings or windows 82 (FIGS. 1 and 4). Thus, the nozzle center hub 70 may be inserted into the support hub 60 on the nozzle carrier, with the ring 76 and spokes 78 located outside the support hub 60. This enables the resilient spring tabs 62, 64 to be received in a diametrically-opposed pair of the windows 82, with shoulders 66, 68 seated on, and resiliently pressed against the lower edges of the windows. Nozzles of this type are described in greater detail in commonly-owned U.S. Pat. No. 5,415,348. It will thus be appreciated that the nozzle 14 is firmly held in place on the nozzle carrier 16, but can be removed easily by pivoting the nozzle carrier 16 to the nozzle-offset or sprinkler shut-off position, squeezing the spring tabs 62, 64 inwardly and sliding the nozzle off the support hub 60. It will be understood that while two resilient tabs 62, 64 are shown, it is contemplated that more than two such tabs could also be used to secure the nozzle on the nozzle holder.

The upper surface of the nozzle support platform 56 is shaped to provide a concave shut-off surface portion 84 (see especially FIGS. 2, 3, 4, 7, 9 and 10) to one side of the bore 58, and an outer pair of resilient carrier locking arms 86, 88 extending outwardly and downwardly from the support platform 56. Each arm 86, 88 is formed with a laterally extending retention tab 90, 92, respectively (both visible in FIG. 10), engageable with the lower ends of the struts 34, 36 (see FIG. 4). More specifically, the arms 86, 88 are designed to flex inwardly when squeezed, permitting the retention tabs 90, 92 to slide along the inside surfaces of the struts 34, 36. The retention tabs 90, 92 and arms 86, 88 are located and sized such that edges of the respective tabs 90, 92 engage the struts in both the nozzle-installed and shut-off positions. More specifically, as the nozzle carrier 16 reaches the nozzle-installed position shown in FIG. 2, the arm 88 springs outwardly, with edge 93 of the tab 92 engaging the edge 37 of the strut 36. A corresponding edge 91 (FIG. 10) of tab 90 engages an edge 31 of strut 34 in the same manner. As a result, the nozzle carrier 16 is prevented from any further swinging movement (or over-travel) to the left as viewed in FIG. 2. Over-travel in the opposite direction is prevented by engagement of the nozzle 14 with a U-shaped guide/stop rib 98 as best seen in FIG. 3 even if the arms 86, 88 remain squeezed or compressed during such movement. The generally U-shaped guide/stop rib 98 on the upper surface of the intermediate nozzle guide platform 30 also serves to guide the nozzle 14 into place as it swings into and out of the nozzle-installed position.

Figure 2:
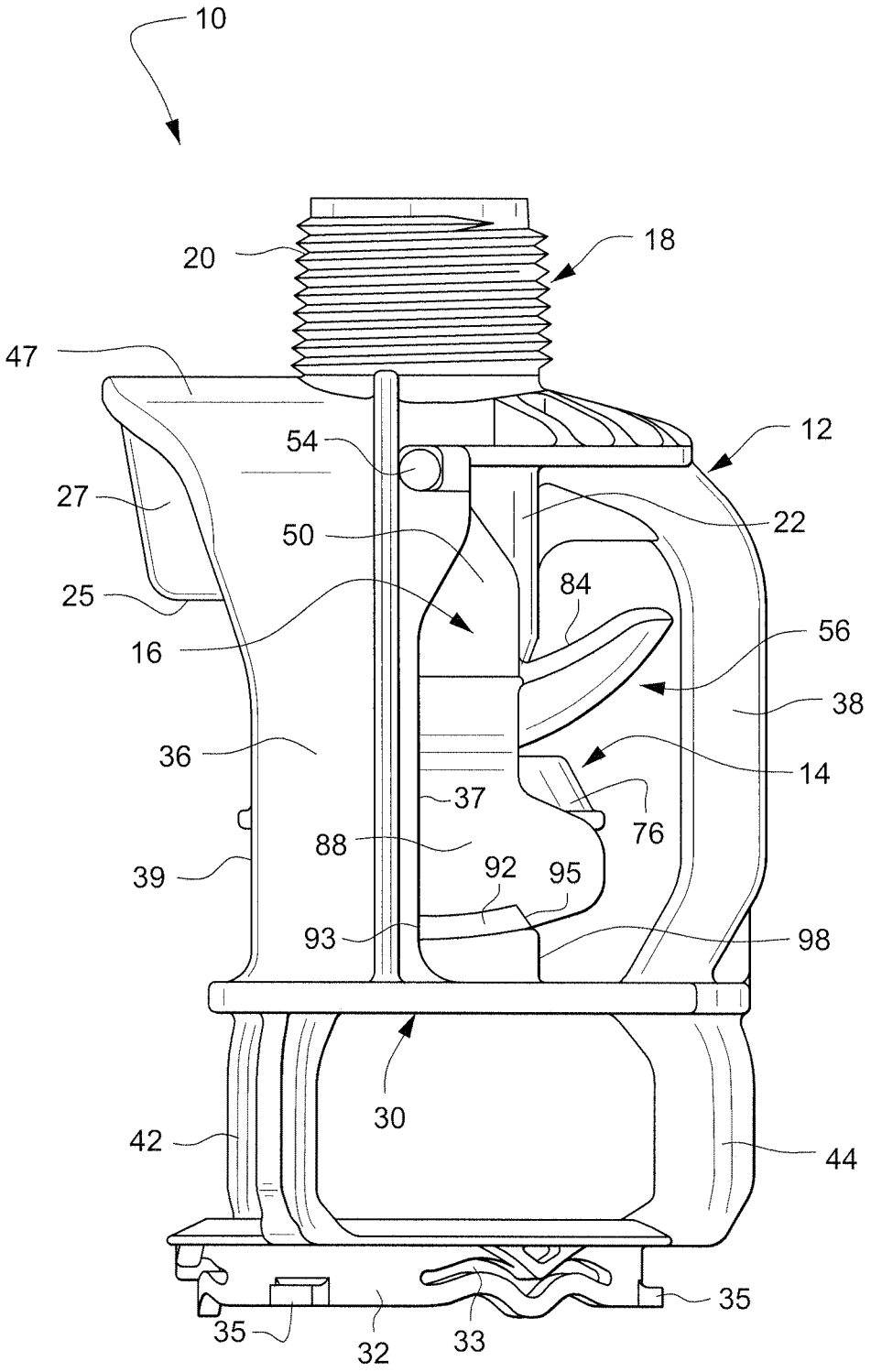
FIG. 2 is a right side view of the sprinkler head shown in FIG. 1.

A similar action occurs when the arms 86, 88 are squeezed to move the tabs 90, 92 inwardly and rotated from the position shown in FIG. 2 to the nozzle-offset or sprinkler shut-off position shown in FIG. 6. Now the edge 95 of the tab 92 engages the edge 39 of the strut 36, preventing any movement of the shuttle 16 back toward the nozzle-installed position. Similar interaction occurs with the tab 90 and the strut 34 on the opposite side of the sprinkler head, i.e., the edge 97 of the tab 90 engages the edge 29 of the strut 34. Over-travel in the opposite direction is prevented by engagement of the nozzle support platform 56 with a lower edge 25 of a reinforcing strut 27 on the cylindrical portion 22.

In the nozzle-installed or operative position of the nozzle carrier 16, the flow passage 24, bore 58, center opening 46, and nozzle bore 72 are axially aligned, and the shut-off surface portion 84 is offset to one side, as best appreciated from FIG. 3. A seal 100 (EPDM rubber or other suitable material) installed at the outlet end of the extended cylindrical portion 22 of the adapter 18, surrounds the outlet 102 of the flow passage 24 and seals against the platform 56, about the bore 58.

When it is desired to simply shut-off the sprinkler, the user will squeeze the arms 86, 88 and pivot the nozzle carrier 16 about the pivot pins 52, 54 to the nozzle-offset or sprinkler shut-off position shown in FIGS. 6 and 7. In this position, seal 100 engages the shut-off surface portion 84 and thus effectively shuts off flow through the sprinkler head at the surface portion 84.

If it is also desired to change the nozzle to one of a different size, the nozzle 14 may be removed from the carrier 16 as described above, with easy access to the nozzle afforded when the carrier 16 is rotated to the sprinkler shut-off position. Note also that in this position, the shield portion 47 protects the offset nozzle 14 as best seen in FIGS. 6 and 7. With a new nozzle installed on the nozzle holder, the nozzle carrier 16 may be pivoted back to the nozzle-installed position while simultaneously moving the shut-off surface portion 84 away from the inlet passage 24 and aligning nozzle bore 72 with flow passage 24, thereby permitting flow through the newly-installed nozzle.

In the exemplary but nonlimiting embodiment, the optional coupling ring 32 is formed with surface/fastening features such as slots 33 and/or tabs 35 that enable easy attachment of a rotatable water deflector plate to complete the sprinkler assembly. In most applications the center of the deflector plate lies on the axis A and may be stationary or rotatable about the axis. The specific manner of attachment forms no part of the invention, and may include a press-and-turn mechanism, a bayonet fitting, a threaded connection or any other suitable coupling arrangement. The water deflector plate and related support structure may be of the type available from the assignee in a series of sprinklers known as Rotator® sprinklers, but the invention is not limited to use with any specific water deflector plate configuration nor is the invention limited to use with sprinklers that utilize water deflector plates. In other words, the invention is applicable to sprinklers where the nozzle orifice is curved to direct the water radially outwardly, or in any other configuration where water is emitted from the nozzle without impinging upon any other sprinkler structure.

Figure 11:
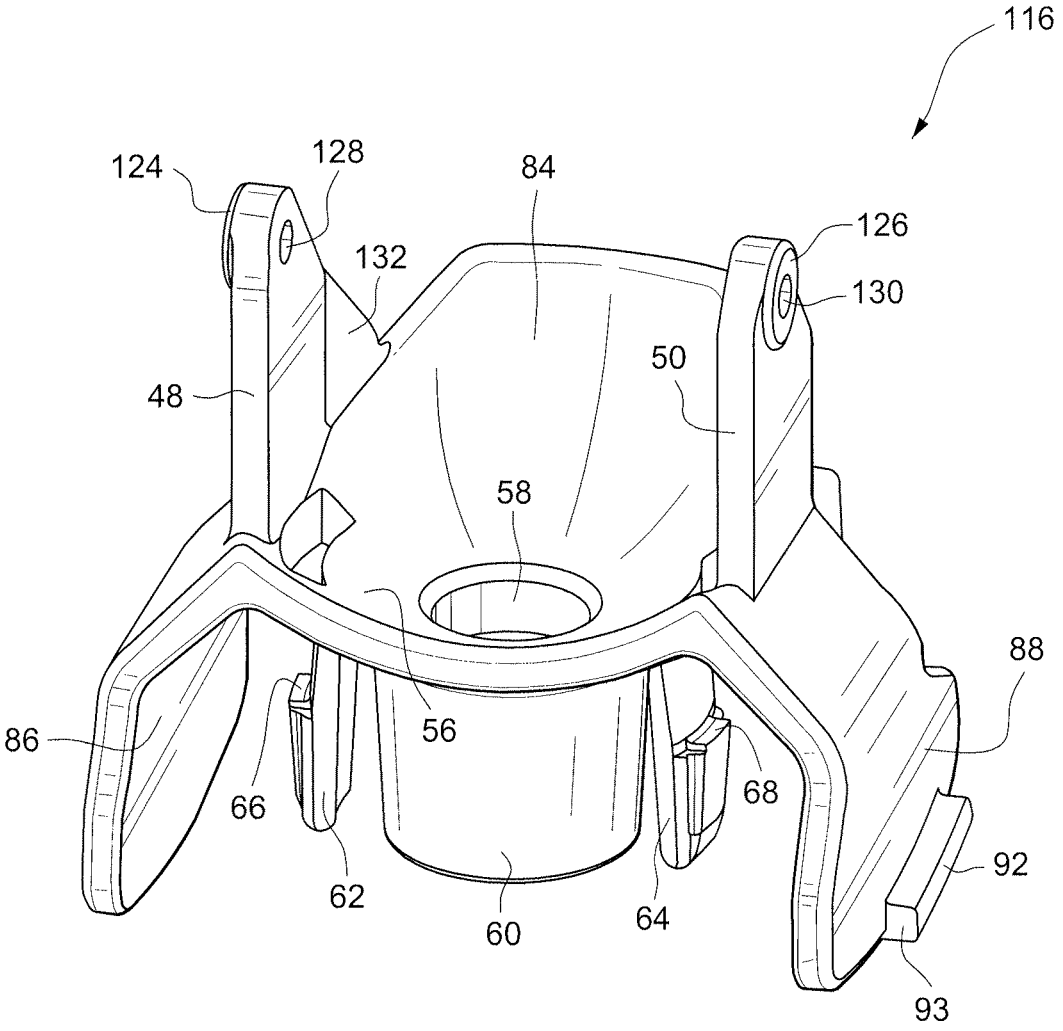
FIG. 11 is a perspective view of a nozzle carrier in accordance with a second exemplary but nonlimiting embodiment.
Figure 12:
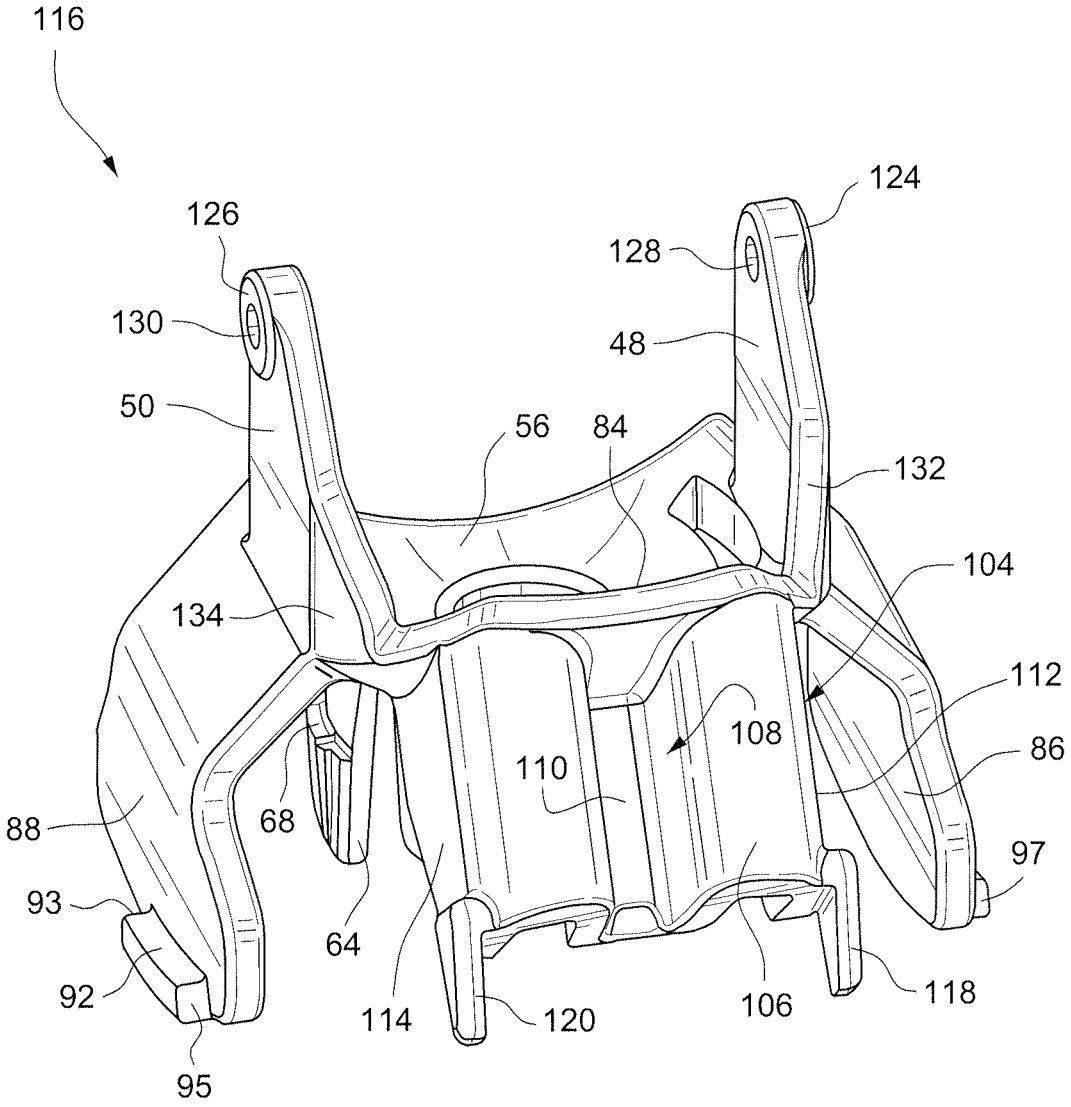
FIG. 12 is another perspective view of the nozzle carrier shown in FIG. 11.
Figure 13:
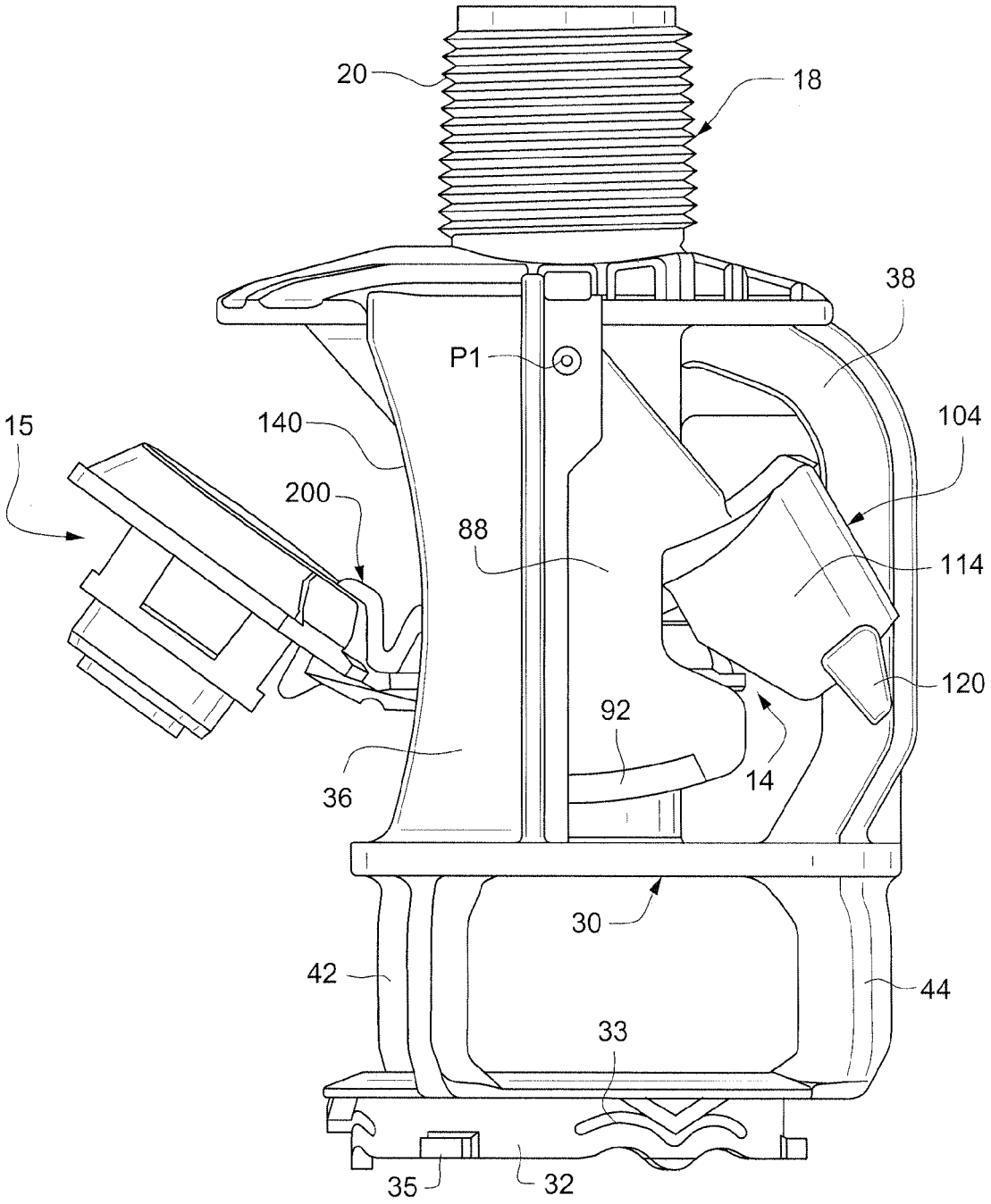
FIG. 13 is a side elevation of a sprinkler head incorporating the nozzle carrier of FIGS. 11 and 12 in a second exemplary but nonlimiting embodiment of the invention.

FIGS. 11 and 12 illustrate a modified nozzle carrier 116 in a second exemplary but nonlimiting embodiment. Where convenient and consistent, the same reference numerals used in FIGS. 9 and 10 are used in FIGS. 11 and 12 to designate corresponding and substantially identical elements/surface features. With reference especially to FIG. 12, directly under the concave shut-off surface portion 84 of the modified nozzle carrier 116 is a reinforcing structure 104 formed essentially as a three-sided housing, but where the closed side 106 is formed with a center groove 108 that is adapted to receive the opposed sprinkler body strut 38 when the nozzle carrier 116 is in the nozzle installed position (see FIGS. 13-15). The base surface 110 of the groove 108 thus provides a stop for pivoting movement of the nozzle carrier 116 in the nozzle-installation direction. The reinforcing structure 104 also provides greater stability to the nozzle carrier 116 in the nozzle-installed position, thus reducing the potential for leakage about the carrier/sprinkler body interface described further below.

Figure 14:
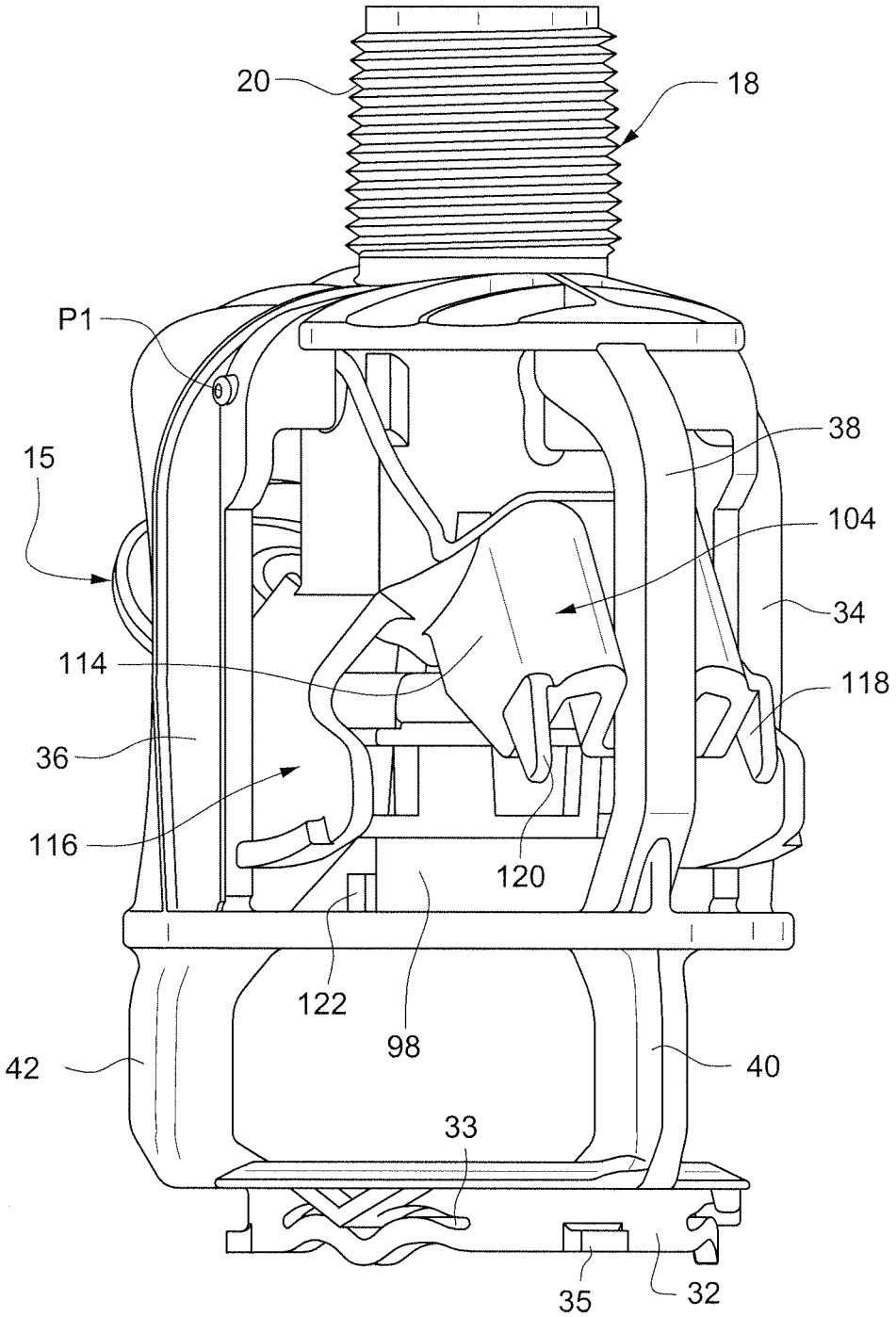
FIG. 14 is a rear perspective view of the sprinkler head shown in FIG. 13.
Figure 15:
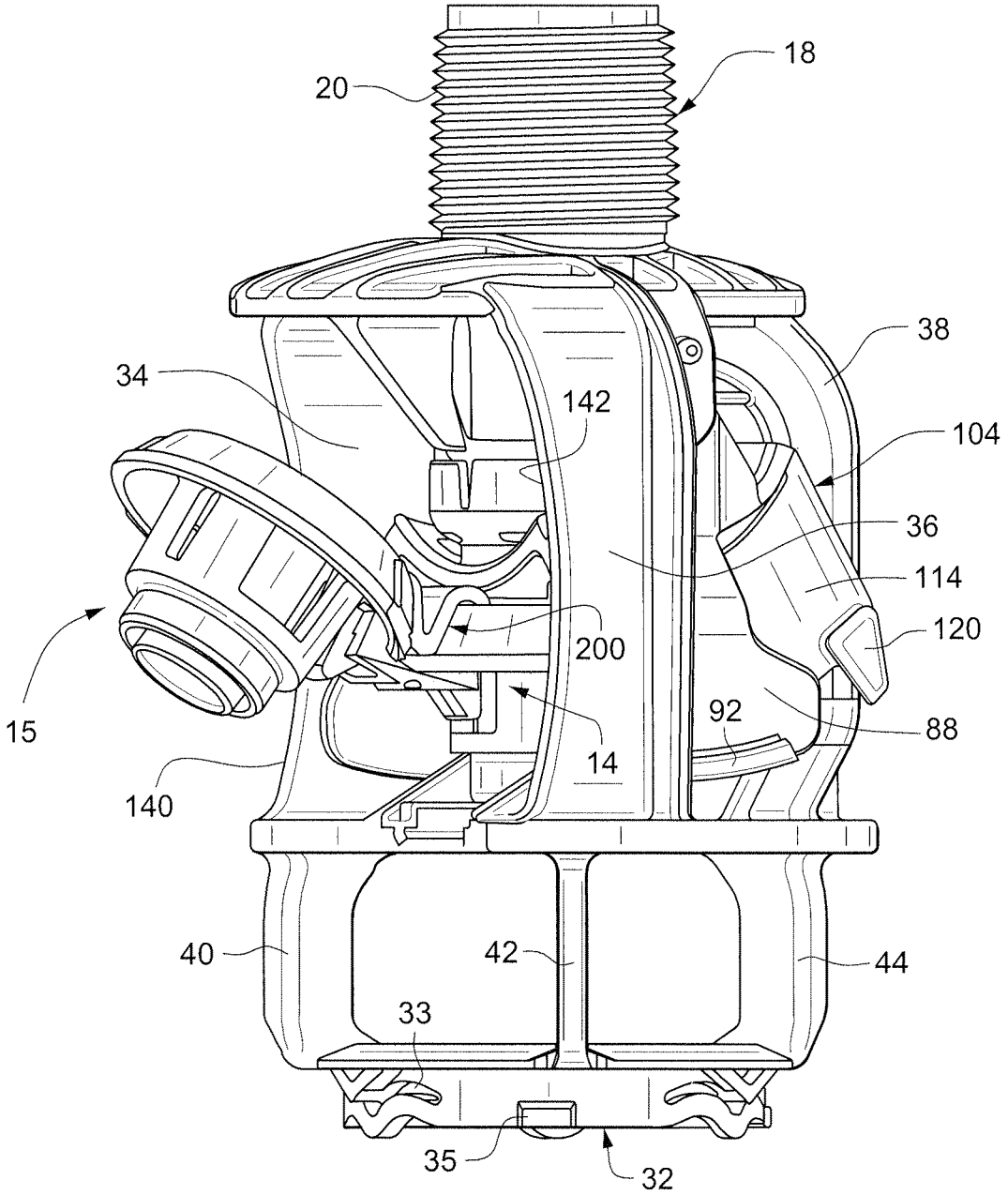
FIG. 15 is a front perspective view of the sprinkler head shown in FIGS. 13 and 14.
Figure 16:
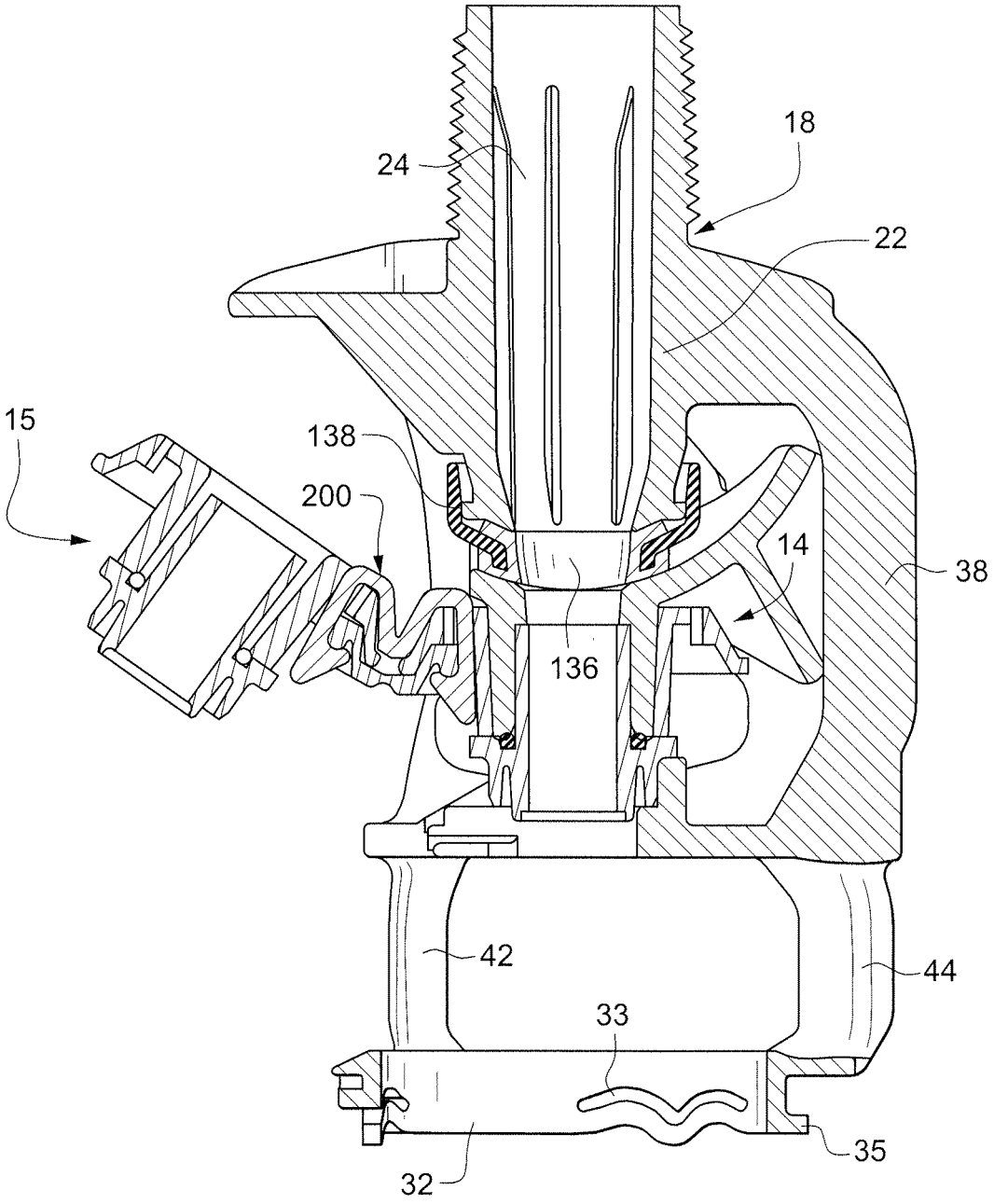
FIG. 16 is a vertical section through the center of the sprinkler head as shown in FIG. 13.

The lower edges of the reinforcing structure side panels 112, 114 are provided with depending ears 118, 120, respectively, that are adapted to engage vertically-oriented ribs 122 (one shown in FIGS. 14 and 17) on the U-shaped guide/stop rib 98, thus providing limit stops for the pivoting movement of the nozzle carrier 116 when it reaches the sprinkler shut-off position (see FIGS. 14, 16). In other words, the base surface 110 of the groove 108 and the ribs 122 prevent over-travel of the nozzle carrier 116 in its two respectively opposite directions of swinging movement, between the nozzle-installed and nozzle-offset (or sprinkler shut-off) positions.

The nozzle carrier pivot ears 48, 50 are formed with bosses 124, 126 and respective bores 128, 130 which receive discrete pivot pins (not shown in FIGS. 11 and 12 but one of which, P1, is visible in FIGS. 13, 14 and 17) extending between adjacent pin-receiving bosses on the sprinkler body. The pins P1 are preferably stainless steel but other metals may be suitable. The nozzle carrier pivot ears 48, 50 are also extended and slanted inwardly as shown at 132, 134 to support or reinforce a greater portion of the nozzle support platform 56, and specifically along the side edges of the concave shut-off surface portion 84.

Figure 17:
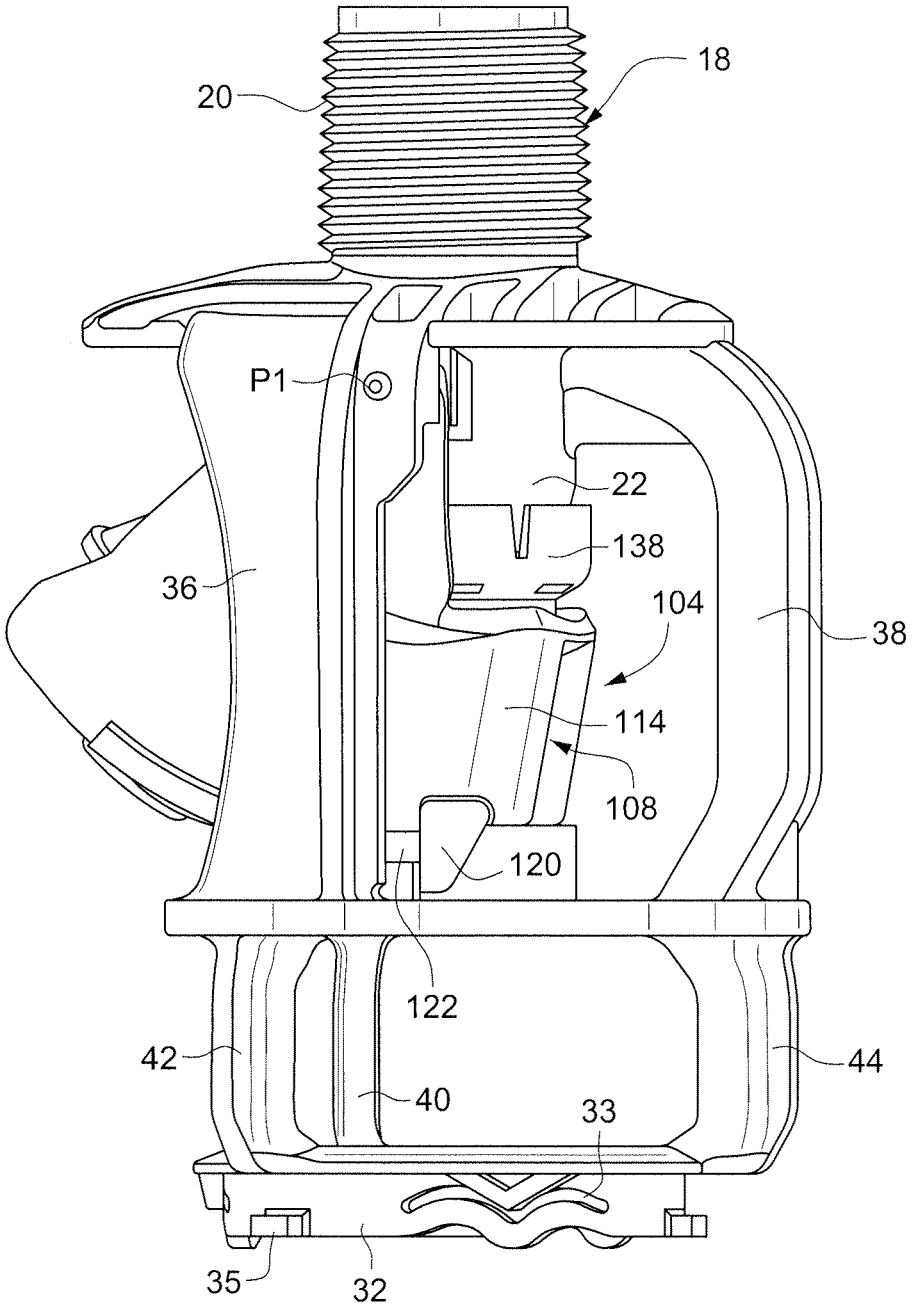
FIG. 17 is a side elevation view of the sprinkler head shown in FIG. 13 but with the nozzle carrier shown in the nozzle offset position, and with the second interchangeable nozzle removed.
Figure 18:
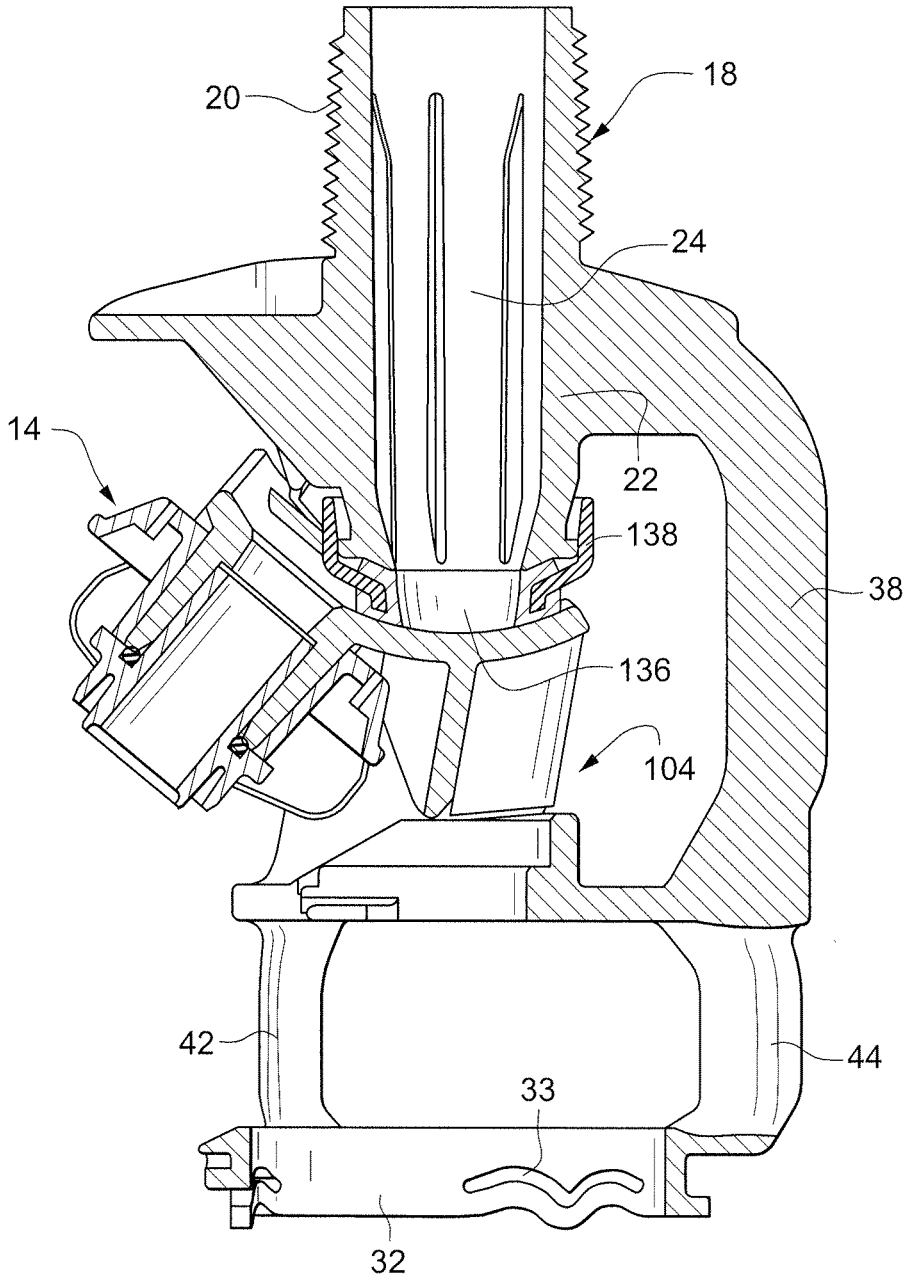
FIG. 18 is a vertical section through the center of the sprinkler head as shown in FIG. 17.

FIGS. 17 and 18 show the modified nozzle carrier 116 in the nozzle-offset or sprinkler shut-off position, and note that the nozzle clip 200 holding a second nozzle 15, (shown in FIGS. 13, 15 and 16) as described in further detail below, has been omitted from these figures.

In this second exemplary embodiment, a more robust seal and seal carrier is applied over the lower end of the extended adapter portion 22 of the sprinkler body. Specifically, an annular flexible seal 136 (see especially FIG. 16) is supported on an annular ring 138 that is engaged and secured over the lower end of the extended-adapter portion 22.

In a further modification, the struts 34 and 36 are provided with curved edges 140, 142 respectively, to better facilitate the desired engagement with the edges 95, 97 of the tabs 92, 90 on the nozzle carrier as explained above in connection with the first-described embodiment.

Except for the modifications noted above, the sprinkler body and nozzle carrier are substantially identical to the sprinkler body and nozzle carrier shown in FIGS. 1-8 and operate in a substantially identical manner.

Figure 19:
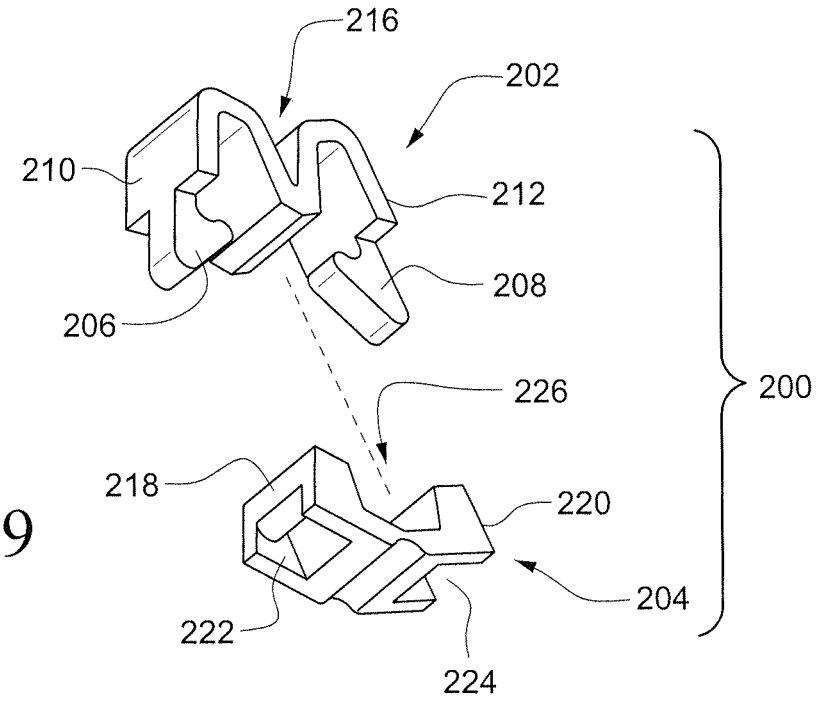
FIG. 19 is an exploded side elevation view of a nozzle clip in accordance with an exemplary but nonlimiting embodiment of the invention.
Figure 20:
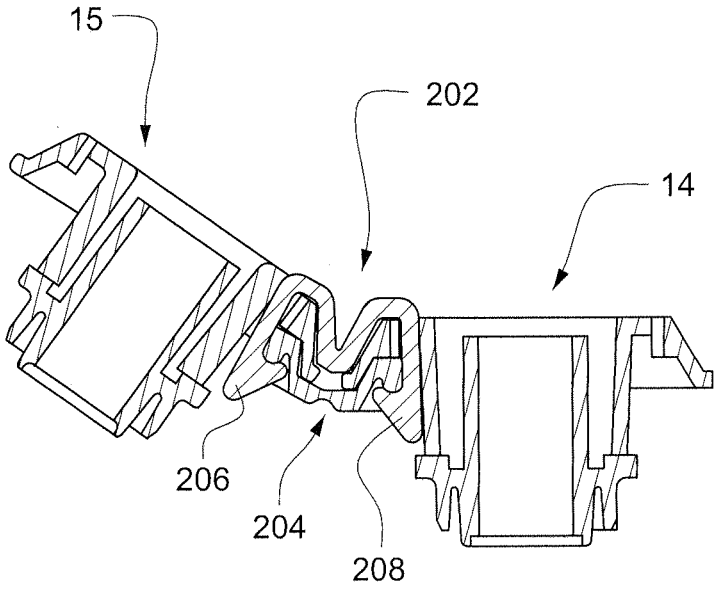
FIG. 20 is a side elevation of the pair of nozzles removed from the sprinkler head as shown in FIG. 16, and held together by the nozzle clip shown in FIG. 19.

In another optional feature of the invention, a nozzle clip 200 (FIGS. 13, 15, 16 and 19) may be employed to gang or couple a pair of nozzles 14, 15 (identical except for orifice size) and thus facilitate a quick and easy nozzle exchange. The clip 200 is shown in exploded form in FIG. 19 and includes a flexible attachment member 202 and a flexible locking member 204. The attachment member 202 has a substantially M shape, with ratchet teeth 206, 208 formed at free ends of the outwardly-flared side stems 210, 212 on either side of the inverted V-shaped center portion 216. The locking member 204 is formed with opposite sides 218, 220, each incorporating a locking recess 222, 224, respectively, adapted to receive one of the ratchet teeth 206, 208 on the attaching member. A center groove 226 facilitates flexing of the locking member. FIG. 20 illustrates how the attachment member 202 may be "threaded" through the windows 82 of the adjacent nozzles 14, 15, and the locking member 204 sprung or snapped into place with ratchet teeth 206, 208 engaged in the locking recesses 222, 224 to thereby hold the two nozzles 14, 15 together. It will be appreciated that when the nozzle carrier 116 is in the sprinkler shut-off position, the installed nozzle can be easily removed from the holder on the nozzle carrier 116, and the clip 200 may then be rotated through 180 degrees, and the second nozzle 15 pushed onto the nozzle holder on the carrier 116.

While the invention has been described in connection with what is presently considered to be the most practical and preferred embodiment, it is to be understood that the invention is not to be limited to the disclosed embodiment, but on the contrary, is intended to cover various modifications and equivalent arrangements.

What is claimed is:

1. A sprinkler head comprising:

a sprinkler body having a flow passage including an inlet at one end thereof; and a nozzle carrier supporting at least one nozzle, said nozzle carrier supported on said sprinkler body downstream of said flow passage for pivoting movement about a substantially horizontal axis between a nozzle-installed position where said at least one nozzle is aligned with said flow passage and a nozzle-offset position where a shut-off surface portion of said nozzle carrier is aligned with said flow passage for shutting off flow through said sprinkler body, wherein said flow passage has an outlet at an opposite end of said sprinkler body coaxially-aligned with a nozzle bore in said at least one nozzle when said nozzle carrier is in said nozzle-installed position, and wherein said sprinkler body includes a nozzle guide platform located axially downstream of the nozzle carrier, said guide platform provided with an opening aligned with said flow passage and with said nozzle bore when said nozzle carrier is in said nozzle-installed position.

2. A sprinkler head comprising:

a sprinkler body having a flow passage including an inlet at one end thereof; and a nozzle carrier supporting at least one nozzle, said nozzle carrier supported on said sprinkler body downstream of said flow passage for pivoting movement about a substantially horizontal axis between a nozzle-installed position where said at least one nozzle is aligned with said flow passage and a nozzle-offset position where a shut-off surface portion of said nozzle carrier is aligned with said flow passage for shutting off flow through said sprinkler body, wherein said flow passage has an outlet at an opposite end of said sprinkler body coaxially-aligned with a nozzle bore in said at least one nozzle when said nozzle carrier is in said nozzle-installed position, and wherein said nozzle carrier is provided with pivot pins receivable in pivot bosses provided on said sprinkler body.

3. The sprinkler head of claim 2 wherein a nozzle holder is provided on one side of said nozzle carrier, and wherein said shut-off surface portion is laterally adjacent said nozzle holder but on an opposite side of said nozzle carrier.

4. A sprinkler head comprising:

a sprinkler body having a flow passage including an inlet at one end thereof; and a nozzle carrier supporting at least one nozzle, said nozzle carrier supported on said sprinkler body downstream of said flow passage for pivoting movement about a substantially horizontal axis between a nozzle-installed position where said at least one nozzle is aligned with said flow passage and a nozzle-offset position where a shut-off surface portion of said nozzle carrier is aligned with said flow passage for shutting off flow through said sprinkler body, wherein said flow passage has an outlet at an opposite end of said sprinkler body coaxially-aligned with a nozzle bore in said at least one nozzle when said nozzle carrier is in said nozzle-installed position, and wherein said sprinkler body is provided with a seal surrounding said outlet, said seal adapted to engage said nozzle carrier when nozzle carrier is in both the nozzle-offset and nozzle-installed positions.

5. The sprinkler head of claim 4 wherein said seal is supported in a seal carrier received on said sprinkler body.

6. The sprinkler head of claim 1 wherein the nozzle guide platform is connected to the sprinkler body by at least two struts.

7. The sprinkler head of claim 1 wherein said nozzle carrier is releasably locked to the sprinkler body in both the nozzle-offset and nozzle-installed positions.

8. A sprinkler head comprising:

a sprinkler body having a flow passage including an inlet at one end thereof; and a nozzle carrier supporting at least one nozzle, said nozzle carrier supported on said sprinkler body downstream of said flow passage for pivoting movement about a substantially horizontal axis between a nozzle-installed position where said at least one nozzle is aligned with said flow passage and a nozzle-offset position where a shut-off surface portion of said nozzle carrier is aligned with said flow passage for shutting off flow through said sprinkler body, wherein said nozzle carrier is releasably locked to the sprinkler body in both the nozzle-offset and nozzle-installed positions, and wherein said nozzle carrier is formed with spring arms provided with tabs engageable with edges of said at least two struts in both the nozzle-installed and the nozzle-offset positions.

9. The sprinkler head of claim 6 wherein a protective shield extends outwardly from between said at least two struts to at least partially cover said at least one nozzle when the nozzle carrier is pivoted to the nozzle-offset position.

10. A sprinkler head comprising:

a sprinkler body having a bore extending therethrough and defining a flow passage;

a nozzle carrier supporting at least one nozzle, said nozzle carrier supported on said sprinkler body for pivoting movement between a nozzle-offset position and a nozzle-installed position, said nozzle carrier also provided with a shut-off surface for shutting off flow through said flow passage when said nozzle carrier is moved to the nozzle-offset position; and wherein said nozzle carrier is releasably locked to the sprinkler body in the nozzle-installed position by spring arms provided with tabs engageable with said sprinkler body.

11. The sprinkler head of claim 10 wherein said flow passage is aligned with a nozzle bore of said at least one nozzle when said nozzle carrier is in the nozzle-installed position.

12. The sprinkler head of claim 10 wherein said sprinkler body includes a nozzle guide platform located axially downstream of said nozzle carrier, said guide platform provided with an aperture aligned with a bore in said at least one nozzle when said nozzle carrier is in the nozzle-installed position.

13. The sprinkler head of claim 12 wherein said nozzle guide platform is provided with an upstanding rib for guiding the at least one nozzle into the nozzle-installed position, said upstanding rib also serving as a stop for said pivoting movement of said nozzle carrier in a nozzle-installation direction.

14. The sprinkler head of claim 10 wherein said nozzle carrier is provided with upstanding ears, with pivot pins passing through said upstanding ears and received in pivot bosses provided on said sprinkler body.

15. The sprinkler head of claim 10 wherein said nozzle carrier is provided with a nozzle holder on one side of said nozzle carrier and wherein said shut-off surface is laterally offset from said nozzle holder on an opposite side of said nozzle carrier.

16. The sprinkler body of claim 15 wherein said nozzle holder comprises a support hub and at least two resilient support tabs radially spaced from said support hub, and wherein a center hub of at least one nozzle defining said nozzle bore is received within said support hub.

17. The sprinkler head of claim 10 wherein said sprinkler body is provided with an annular seal surrounding an outlet of said flow passage, said seal engaged with said nozzle carrier in both said nozzle-offset and nozzle-installed positions.

18. A sprinkler head comprising:

a sprinkler body formed with flow passage;

a nozzle carrier supporting at least one nozzle, said nozzle carrier supported on said sprinkler body for pivoting movement about a substantially horizontal axis; wherein said at least one nozzle is aligned with said flow passage when said nozzle carrier is moved to a nozzle-installed position, said nozzle carrier also provided a shut-off surface for shutting off flow through said flow passage when said nozzle carrier is moved to the nozzle-offset position; a nozzle holder on an underside of said nozzle carrier for securing said at least one nozzle on said nozzle carrier, said nozzle holder comprising a support hub including a bore receiving a center hub of at least one nozzle and at least two resilient support tabs radially spaced from said support hub, such that a nozzle bore extending through the nozzle center hub is aligned with said flow passage when the nozzle carrier is in the nozzle-installed position.

19. The sprinkler head according to claim 18 wherein a coupling element is supported downstream of said nozzle carrier, said coupling element adapted for connection with a water deflector plate which, in use, is impinged upon by a stream emitted from said at least one nozzle in the nozzle-installed position.

20. The sprinkler head according to claim 18 wherein said at least one nozzle comprises a pair of nozzles held together by a flexible clip.

21. The sprinkler head of claim 20 wherein said flexible clip comprises a first attachment member including side stems and a center section; and a second locking member adapted to receive and releasably hold free ends of said side stems.

22. The sprinkler head of claim 21 in combination with a pair of nozzles, each nozzle having a support ring formed with plural windows, wherein said side stems are threaded through opposed windows on adjacent nozzles and secured by said second locking member.

* * * * *